US011028861B2

(12) United States Patent
Wang

(10) Patent No.: US 11,028,861 B2
(45) **Date of Patent: *Jun. 8, 2021**

(54) HYDRAULIC SYSTEM AND METHOD FOR REDUCING BOOM BOUNCE WITH COUNTER-BALANCE PROTECTION

(71) Applicant: Eaton Intelligent Power Limited, Dublin (IE)

(72) Inventor: Meng (Rachel) Wang, Eden Prairie, MN (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/707,782

(22) Filed: Dec. 9, 2019

(65) Prior Publication Data

US 2020/0248720 A1 Aug. 6, 2020

Related U.S. Application Data

(63) Continuation of application No. 15/804,542, filed on Nov. 6, 2017, now Pat. No. 10,502,239, which is a (Continued)

(51) Int. Cl.
*F15B 11/00* (2006.01)
*E02F 9/22* (2006.01)
(Continued)

(52) U.S. Cl.
CPC ..... *F15B 11/003* (2013.01); *B66C 13/066* (2013.01); *E02F 9/2207* (2013.01);
(Continued)

(58) Field of Classification Search
CPC .. F15B 11/0445; F15B 11/003; F15B 21/008; B66C 13/066; E04G 21/0454
See application file for complete search history.

(56) References Cited

U.S. PATENT DOCUMENTS 3,917,246 A 11/1975 Gartner et al.
4,621,375 A 11/1986 Simnovec
(Continued)

FOREIGN PATENT DOCUMENTS

CN 202322251 7/2012
CN 102705288 A 10/2012
(Continued)

OTHER PUBLICATIONS

Extended European Search Report for corresponding European Patent Application No. 15822402.2 dated Mar. 6, 2018, 8 pages.
(Continued)

*Primary Examiner* — Thomas E Lazo
(74) *Attorney, Agent, or Firm* — Merchant & Gould P.C.

(57) ABSTRACT

A hydraulic system (600) and method for reducing boom dynamics of a boom (30), while providing counter-balance valve protection, includes a hydraulic cylinder (110), first and second counter-balance valves (300, 400), first and second control valves (700, 800), and a selection valve set (850). The selection valve set is adapted to self-configure to a first configuration and to a second configuration when a net load (90) is supported by a first chamber (116, 118) and a second chamber (118, 116) of the hydraulic cylinder, respectively. When the selection valve set is enabled in the first and second configurations, the second and first control valve may fluctuate hydraulic fluid flow to the second and first chamber, respectively, to produce a vibratory response (950) that counters environmental vibrations (960) of the boom. When the selection valve set is not enabled, the first and second counter-balance valves are adapted to provide the hydraulic cylinder with conventional counter-balance valve protection.

8 Claims, 5 Drawing Sheets

Related U.S. Application Data continuation of application No. 14/894,662, filed as application No. PCT/US2014/037879 on May 13, 2014, now Pat. No. 9,810,242.

(60) Provisional application No. 61/829,796, filed on May 31, 2013.

(51) Int. Cl.

| | |
|---|---|
| ***B66C 13/06*** | (2006.01) |
| ***E04G 21/04*** | (2006.01) |
| ***F15B 21/00*** | (2006.01) |
| ***F15B 11/044*** | (2006.01) |

(52) U.S. Cl.

CPC ..... *E04G 21/0454* (2013.01); *F15B 11/0445* (2013.01); *F15B 21/008* (2013.01); *F15B 2211/3057* (2013.01); *F15B 2211/30515* (2013.01); *F15B 2211/329* (2013.01); *F15B 2211/5059* (2013.01); *F15B 2211/526* (2013.01); *F15B 2211/6313* (2013.01); *F15B 2211/6658* (2013.01); *F15B 2211/8616* (2013.01)

(56) References Cited

U.S. PATENT DOCUMENTS

| | | | | |
|---|---|---|---|---|
| 4,896,582 | A * | 1/1990 | Tordenmalm | E02F 9/2214 91/361 |
| 5,048,296 | A | 9/1991 | Sunamura et al. | |
| 5,191,826 | A | 3/1993 | Brunner | |
| 5,245,826 | A * | 9/1993 | Roth | E02F 9/2217 60/413 |
| 5,640,996 | A | 6/1997 | Schlecht et al. | |
| 5,699,386 | A | 12/1997 | Measor et al. | |
| 5,784,944 | A * | 7/1998 | Tozawa | E02F 3/437 91/361 |
| 5,832,730 | A * | 11/1998 | Mizui | B66C 13/066 60/469 |
| 5,996,465 | A | 12/1999 | Morikawa et al. | |
| 6,202,013 | B1 | 3/2001 | Anderson et al. | |
| 6,328,173 | B1 | 12/2001 | Wimmer | |
| 6,634,172 | B2 | 10/2003 | Schoonmaker et al. | |
| 6,883,532 | B2 * | 4/2005 | Rau | B66C 13/066 137/1 |
| 7,143,682 | B2 * | 12/2006 | Nissing | B66C 13/066 91/358 R |
| 7,278,262 | B2 * | 10/2007 | Moon | E02F 9/2207 60/426 |
| 7,296,404 | B2 | 11/2007 | Pfaff | |
| 7,729,832 | B2 * | 6/2010 | Benckert | E04G 21/04 701/49 |
| 8,037,682 | B2 * | 10/2011 | Yi | B66C 13/066 60/469 |
| 8,082,083 | B2 * | 12/2011 | Pirri | E04G 21/04 701/50 |
| 9,810,242 | B2 * | 11/2017 | Wang | B66C 13/066 |
| 9,933,328 | B2 | 4/2018 | Rannow | |
| 10,036,407 | B2 * | 7/2018 | Rannow | F15B 11/003 |
| 10,316,929 | B2 | 6/2019 | Wang et al. | |
| 10,323,663 | B2 | 6/2019 | Wang et al. | |
| 10,344,783 | B2 | 7/2019 | Wang et al. | |
| 10,502,239 | B2 * | 12/2019 | Wang | F15B 11/0445 |
| 10,605,277 | B2 | 3/2020 | Wang et al. | |
| 10,724,552 | B2 * | 7/2020 | Rannow | F15B 11/0445 |
| 2002/0092417 | A1 | 7/2002 | Suzuki et al. | |
| 2003/0159576 | A1 | 8/2003 | Schoonmaker et al. | |
| 2006/0272325 | A1 | 12/2006 | Moon | |
| 2010/0186401 | A1 | 7/2010 | Kauss et al. | |
| 2011/0088785 | A1 | 4/2011 | Balasubramania | |
| 2011/0179783 | A1 * | 7/2011 | Pirri | F15B 21/008 60/420 |
| 2012/0198832 | A1 | 8/2012 | Fukumoto | |
| 2016/0108936 | A1 | 4/2016 | Wang | |
| 2016/0222989 | A1 | 8/2016 | Rannow et al. | |
| 2016/0298660 | A1 | 10/2016 | Wang et al. | |
| 2016/0298719 | A1 | 10/2016 | Wang et al. | |
| 2017/0204886 | A1 | 7/2017 | Wang et al. | |
| 2020/0003239 | A1 | 1/2020 | Wang et al. | |

FOREIGN PATENT DOCUMENTS

| | | |
|---|---|---|
| DE | 10253871 | 8/2004 |
| DE | 202009007668 | 10/2009 |
| EP | 0457913 | 11/1991 |
| EP | 1134431 | 5/2005 |
| EP | 2347988 | 7/2011 |
| EP | 2503161 | 9/2012 |
| JP | H05163746 | 6/1993 |
| JP | 6147259 | 5/1994 |
| JP | 7113436 | 5/1995 |
| JP | 7300881 | 11/1995 |
| JP | 9041428 | 2/1997 |
| JP | 3079498 | 8/2000 |
| JP | 200320197 | 1/2003 |
| JP | 2004301214 | 10/2004 |
| JP | 2004308746 | 11/2004 |
| JP | 2006300280 | 11/2006 |
| JP | 2009074692 | 4/2009 |
| JP | 101190553 | 10/2012 |
| JP | 2012197937 | 10/2012 |
| JP | 2013035527 | 2/2013 |
| KR | 10-1190553 B1 | 10/2012 |
| WO | 2015031821 | 3/2015 |
| WO | 2015073329 | 5/2015 |
| WO | 2015073330 | 5/2015 |
| WO | 2015191661 | 12/2015 |
| WO | 2016011193 | 1/2016 |

OTHER PUBLICATIONS

Ultronics ZTS16 Control Architecture Overview, Version 1.3, 18 pages (Jul. 2010).

Ultronics ZTS16 User Manual V1.0 (for SW Version 2.3 & OD Version 2.2, 52 pages (Nov. 25, 2009).

Extended European Search Report for Application No. 14803575.1 dated Dec. 20, 2016.

Extended European Search Report for corresponding European Patent Application No. 14840792.7 dated May 9, 2017, 5 pages.

Extended European Search Report for Application No. 14862808.4 dated May 17, 2017.

Extended European Search Report for Application No. 14861695.6 dated Jun. 23, 2017.

Honma, K. et al. "Vibration Damping Control for Construction Machinery with a Long Arm Manipulator," Journal of the Robotics Society of Japan (JRSJ), vol. 6, No. 5, pp. 99-102 (Oct. 1988).

International Search Report for corresponding International Patent Application No. PCT/US2014/037879 dated Sep. 22, 2014.

International Search Report for corresponding International Patent Application No. PCT/US2014/053523 dated Dec. 3, 2014.

International Search Report for corresponding International Patent Application No. PCT/US2014/064646 dated Mar. 12, 2015.

International Search Report and Written Opinion of the International Searching Authority for corresponding International Patent Application No. PCT/US2015/040636 dated Oct. 15, 2015, 8 pgs.

International Search Report for corresponding International Patent Application No. PCT/US2014/064651 dated Feb. 16, 2015.

* cited by examiner

HYDRAULIC SYSTEM AND METHOD FOR REDUCING BOOM BOUNCE WITH COUNTER-BALANCE PROTECTION

CROSS-REFERENCE TO RELATED APPLICATION(S)

This application is a Continuation of U.S. patent application Ser. No. 15/804,542, filed Nov. 6, 2017, now U.S. Pat. No. 10,502,239, which is a continuation of U.S. patent application Ser. No. 14/894,662 filed on Nov. 30, 2015, which is a National Stage Application of PCT/US2014/037879 filed on May 13, 2014, which claims benefit of U.S. Patent Application Ser. No. 61/829,796 filed on May 31, 2013, and which applications are incorporated herein by reference. To the extent appropriate, a claim of priority is made to each of the above disclosed applications.

BACKGROUND

Various off-road and on-road vehicles include booms. For example, certain concrete pump trucks include a boom configured to support a passage through which concrete is pumped from a base of the concrete pump truck to a location at a construction site where the concrete is needed. Such booms may be long and slender to facilitate pumping the concrete a substantial distance away from the concrete pump truck. In addition, such booms may be relatively heavy. The combination of the substantial length and mass properties of the boom may lead to the boom exhibiting undesirable dynamic behavior. In certain booms in certain configurations, a natural frequency of the boom may be about 0.3 Hertz (i.e., 3.3 seconds per cycle). In certain booms in certain configurations, the natural frequency of the boom may be less than about 1 Hertz (i.e., 1 second per cycle). In certain booms in certain configurations, the natural frequency of the boom may range from about 0.1 Hertz to about 1 Hertz (i.e., 10 seconds per cycle to 1 second per cycle). For example, as the boom is moved from place to place, the starting and stopping loads that actuate the boom may induce vibration (i.e., oscillation). Other load sources that may excite the boom include momentum of the concrete as it is pumped along the boom, starting and stopping the pumping of concrete along the boom, wind loads that may develop against the boom, and/or other miscellaneous loads.

Other vehicles with booms include fire trucks in which a ladder may be included on the boom, fire trucks which include a boom with plumbing to deliver water to a desired location, excavators which use a boom to move a shovel, tele-handlers which use a boom to deliver materials around a construction site, cranes which may use a boom to move material from place to place, etc.

In certain boom applications, including those mentioned above, a hydraulic cylinder may be used to actuate the boom. By actuating the hydraulic cylinder, the boom may be deployed and retracted, as desired, to achieve a desired placement of the boom. In certain applications, counter-balance valves may be used to control actuation of the hydraulic cylinder and/or to prevent the hydraulic cylinder from uncommanded movement (e.g., caused by a component failure). A prior art system 100, including a first counter-balance valve 300 and a second counter-balance valve 400 is illustrated at FIG. 1. The counter-balance valve 300 controls and/or transfers hydraulic fluid flow into and out of a first chamber 116 of a hydraulic cylinder 110 of the system 100. Likewise, the second counter-balance valve 400 controls and/or transfers hydraulic fluid flow into and out of a second chamber 118 of the hydraulic cylinder 110. In particular, a port 302 of the counter-balance valve 300 is connected to a port 122 of the hydraulic cylinder 110. Likewise, a port 402 of the counter-balance valve 400 is fluidly connected to a port 124 of the hydraulic cylinder 110. As depicted, a fluid line 522 schematically connects the port 302 to the port 122, and a fluid line 524 connects the port 402 to the port 124. The counter-balance valves 300, 400 are typically mounted directly to the hydraulic cylinder 110. The port 302 may directly connect to the port 122, and the port 402 may directly connect to the port 124.

The counter-balance valves 300, 400 provide safety protection to the system 100. In particular, before movement of the cylinder 110 can occur, hydraulic pressure must be applied to both of the counter-balance valves 300, 400. The hydraulic pressure applied to one of the counter-balance valves 300, 400 is delivered to a corresponding one of the ports 122, 124 of the hydraulic cylinder 110 thereby urging a piston 120 of the hydraulic cylinder 110 to move. The hydraulic pressure applied to an opposite one of the counter-balance valves 400, 300 allows hydraulic fluid to flow out of the opposite port 124, 122 of the hydraulic cylinder 110. By requiring hydraulic pressure at the counter-balance valve 300, 400 corresponding to the port 122, 124 that is releasing the hydraulic fluid, a failure of a hydraulic line, a valve, a pump, etc. that supplies or receives the hydraulic fluid from the hydraulic cylinder 110 will not result in uncommanded movement of the hydraulic cylinder 110.

Turning now to FIG. 1, the system 100 will be described in detail. As depicted, a four-way three position hydraulic control valve 200 is used to control the hydraulic cylinder 110. The control valve 200 includes a spool 220 that may be positioned at a first configuration 222, a second configuration 224, or a third configuration 226. As depicted at FIG. 1, the spool 220 is at the first configuration 222. In the first configuration 222, hydraulic fluid from a supply line 502 is transferred from a port 212 of the control valve 200 to a port 202 of the control valve 200 and ultimately to the port 122 and the chamber 116 of the hydraulic cylinder 110. The hydraulic cylinder 110 is thereby urged to extend and hydraulic fluid in the chamber 118 of the hydraulic cylinder 110 is urged out of the port 124 of the cylinder 110. Hydraulic fluid leaving the port 124 returns to a hydraulic tank by entering a port 204 of the control valve 200 and exiting a port 214 of the control valve 200 into a return line 504. In certain embodiments, the supply line 502 supplies hydraulic fluid at a constant or at a near constant supply pressure. In certain embodiments, the return line 504 receives hydraulic fluid at a constant or at a near constant return pressure.

When the spool 220 is positioned at the second configuration 224, hydraulic fluid flow between the port 202 and the port 212 and hydraulic fluid flow between the port 204 and the port 214 is effectively stopped, and hydraulic fluid flow to and from the cylinder 110 is effectively stopped. Thus, the hydraulic cylinder 110 remains substantially stationary when the spool 220 is positioned at the second configuration 224.

When the spool 220 is positioned at the third configuration 226, hydraulic fluid flow from the supply line 502 enters through the port 212 and exits through the port 204 of the valve 200. The hydraulic fluid flow is ultimately delivered to the port 124 and the chamber 118 of the hydraulic cylinder 110 thereby urging retraction of the cylinder 110. As hydraulic fluid pressure is applied to the chamber 118, hydraulic fluid within the chamber 116 is urged to exit through the port 122. Hydraulic fluid exiting the port 122 enters the port 202 and exits the port 214 of the valve 200 and thereby returns to the hydraulic tank. An operator and/or a control system may move the spool 220 as desired and thereby achieve extension, retraction, and/or locking of the hydraulic cylinder 110.

A function of the counter-balance valves 300, 400 when the hydraulic cylinder 110 is extending will now be discussed in detail. Upon the spool 220 of the valve 200 being placed in the first configuration 222, hydraulic fluid pressure from the supply line 502 pressurizes a hydraulic line 512. The hydraulic line 512 is connected between the port 202 of the control valve 200, a port 304 of the counter-balance valve 300, and a port 406 of the counter-balance valve 400. Hydraulic fluid pressure applied at the port 304 of the counter-balance valve 300 flows past a spool 310 of the counter-balance valve 300 and past a check valve 320 of the counter-balance valve 300 and thereby flows from the port 304 to the port 302 through a passage 322 of the counter-balance valve 300. The hydraulic fluid pressure further flows through the port 122 and into the chamber 116 (i.e., a meter-in chamber). Pressure applied to the port 406 of the counter-balance valve 400 moves a spool 410 of the counter-balance valve 400 against a spring 412 and thereby compresses the spring 412. Hydraulic fluid pressure applied at the port 406 thereby opens a passage 424 between the port 402 and the port 404. By applying hydraulic pressure at the port 406, hydraulic fluid may exit the chamber 118 (i.e., a meter-out chamber) through the port 124, through the line 524, through the passage 424 of the counter-balance valve 400 across the spool 410, through a hydraulic line 514, through the valve 200, and through the return line 504 into the tank. The meter-out side may supply backpressure.

A function of the counter-balance valves 300, 400 when the hydraulic cylinder 110 is retracting will now be discussed in detail. Upon the spool 220 of the valve 200 being placed in the third configuration 226, hydraulic fluid pressure from the supply line 502 pressurizes the hydraulic line 514. The hydraulic line 514 is connected between the port 204 of the control valve 200, a port 404 of the counter-balance valve 400, and a port 306 of the counter-balance valve 300. Hydraulic fluid pressure applied at the port 404 of the counter-balance valve 400 flows past the spool 410 of the counter-balance valve 400 and past a check valve 420 of the counter-balance valve 400 and thereby flows from the port 404 to the port 402 through a passage 422 of the counter-balance valve 400. The hydraulic fluid pressure further flows through the port 124 and into the chamber 118 (i.e., a meter-in chamber). Hydraulic pressure applied to the port 306 of the counter-balance valve 300 moves the spool 310 of the counter-balance valve 300 against a spring 312 and thereby compresses the spring 312. Hydraulic fluid pressure applied at the port 306 thereby opens a passage 324 between the port 302 and the port 304. By applying hydraulic pressure at the port 306, hydraulic fluid may exit the chamber 116 (i.e., a meter-out chamber) through the port 122, through the line 522, through the passage 324 of the counter-balance valve 300 across the spool 310, through the hydraulic line 512, through the valve 200, and through the return line 504 into the tank. The meter-out side may supply backpressure.

The supply line 502, the return line 504, the hydraulic line 512, the hydraulic line 514, the hydraulic line 522, and/or the hydraulic line 524 may belong to a line set 500.

SUMMARY

One aspect of the present disclosure relates to systems and methods for reducing boom dynamics (e.g., boom bounce) of a boom while providing counter-balance valve protection to the boom.

Another aspect of the present disclosure relates to a hydraulic system including a hydraulic cylinder, a first counter-balance valve, a second counter-balance valve, a first control valve, a second control valve, and a selection valve arrangement. The hydraulic cylinder includes a first chamber and a second chamber. The first counter-balance valve fluidly connects to the first chamber at a first node, and the second counter-balance valve fluidly connects to the second chamber at a second node. The first control valve fluidly connects to the first counter-balance valve at a third node, and a second control valve fluidly connects to the second counter-balance valve at a fourth node. The selection valve arrangement is fluidly connected to the first node and the second node and is adapted to self-configure to a first configuration set when a net load is supported by the second chamber of the hydraulic cylinder and is further adapted to self-configure to a second configuration set when the net load is supported by the first chamber of the hydraulic cylinder. When the selection valve arrangement is enabled and at the first configuration set, the first control valve is adapted to fluctuate a first hydraulic fluid flow to the first chamber and thereby cause the hydraulic cylinder to produce a first vibratory response.

In certain embodiments, when the selection valve arrangement is enabled and at the second configuration set, the second control valve is adapted to fluctuate a second hydraulic fluid flow to the second chamber and thereby cause the hydraulic cylinder to produce a second vibratory response. In certain embodiments, the first chamber is a rod chamber and the second chamber is a head chamber. In other embodiments, the first chamber is a head chamber and the second chamber is a rod chamber. In certain embodiments, the first counter-balance valve, the second counter-balance valve, and the selection valve arrangement are physically mounted to the hydraulic cylinder.

Still another aspect of the present disclosure relates to a hydraulic valve set including a first counter-balance valve, a second counter-balance valve, and a selection valve arrangement. The first counter-balance valve provides a first backflow protection to a first node. The first counter-balance valve includes a first counter-balance valve opening node. The second counter-balance valve provides a second backflow protection to a second node. The second counter-balance valve includes a second counter-balance valve opening node. The selection valve arrangement is fluidly connected to the first node, the second node, the first counter-balance valve opening node, and the second counter-balance valve opening node. The selection valve arrangement is adapted to self-configure in response to a net spool force produced by a first fluid pressure of the first node and a second fluid pressure of the second node. When the net spool force is in a first direction, the selection valve arrangement connects the first node of the first counter-balance valve to the second counter-balance valve opening node of the second counter-balance valve. When the net spool force is in a second direction, the selection valve arrangement connects the second node of the second counter-balance valve to the first counter-balance valve opening node of the first counter-balance valve.

Yet another aspect of the present disclosure relates to a hydraulic boom control system including a pair of counter-balance valves, a selection valve arrangement, and a pair of control valves. The pair of counter-balance valves is hydraulically coupled to opposite sides of a hydraulic actuator of a boom. The selection valve arrangement senses a net unloaded side of the opposite sides of the hydraulic actuator and opens a one of the pair of counter-balance valves corresponding to the net unloaded side. The pair of control valves corresponds to the opposite sides of the hydraulic actuator. A one of the pair of control valves corresponds to the net unloaded side and transmits a vibratory hydraulic fluid flow to the net unloaded side of the hydraulic actuator.

Still another aspect of the present disclosure relates to a method of controlling vibration in a boom. The method includes: 1) providing a valve arrangement that includes a pair of counter-balance valves, a pair of control valves, and a selector valve set; 2) providing a hydraulic actuator that includes a pair of chambers; 3) configuring the selector valve set with a net load that is applied on the hydraulic actuator and thereby configures the pair of counter-balance valves; 4) locking a loaded chamber of the pair of chambers with a respective one of the pair of counter-balance valves that has been configured by the configuring of the pair of counter-balance valves; and 5) transmitting vibrating hydraulic fluid with a respective one of the pair of control valves to an unloaded chamber of the pair of chambers.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
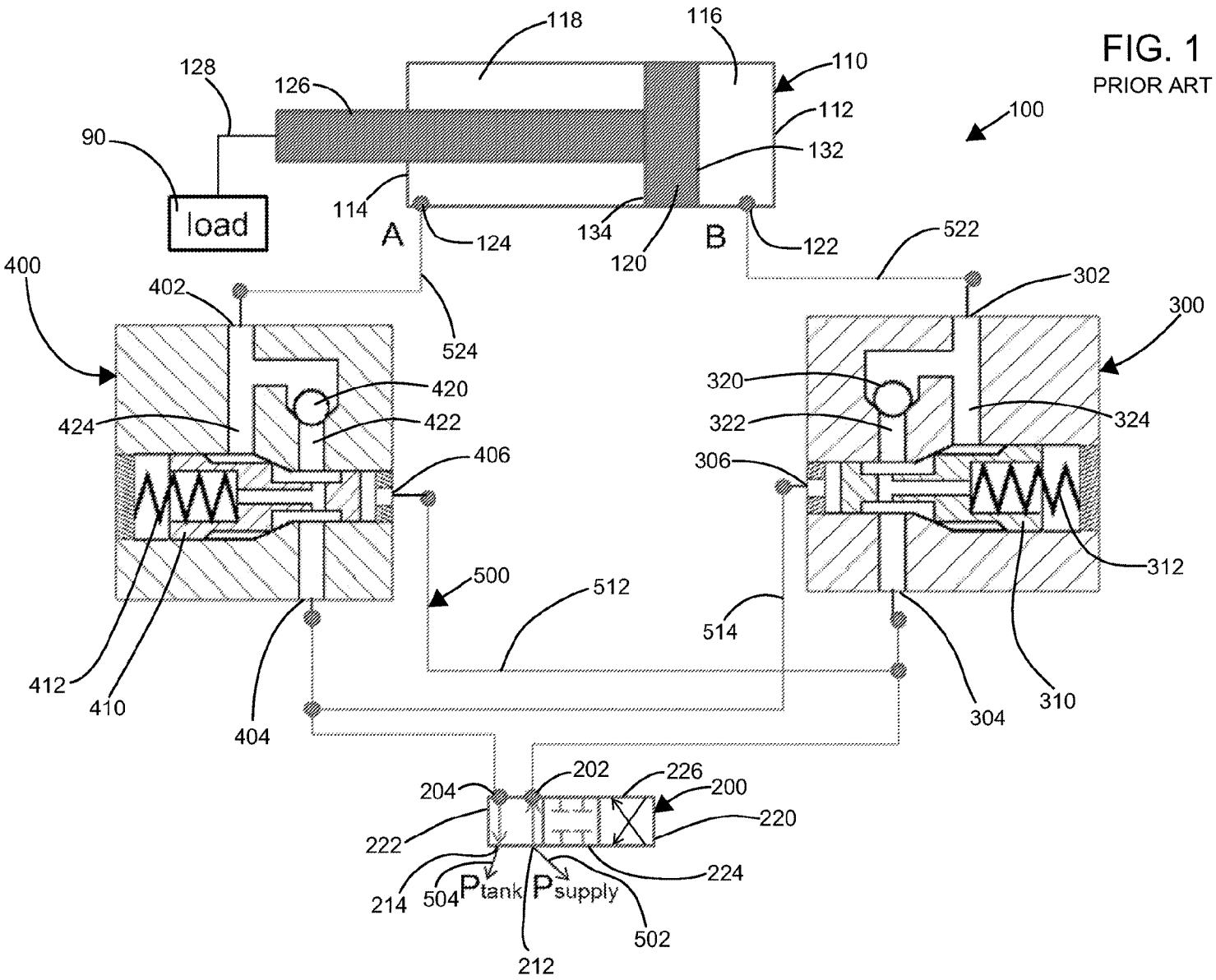
FIG. 1 PRIOR ART
FIG. 1 is a schematic illustration of a prior art hydraulic system including a hydraulic cylinder with a pair of counter-balance valves and a control valve.
Figure 2:
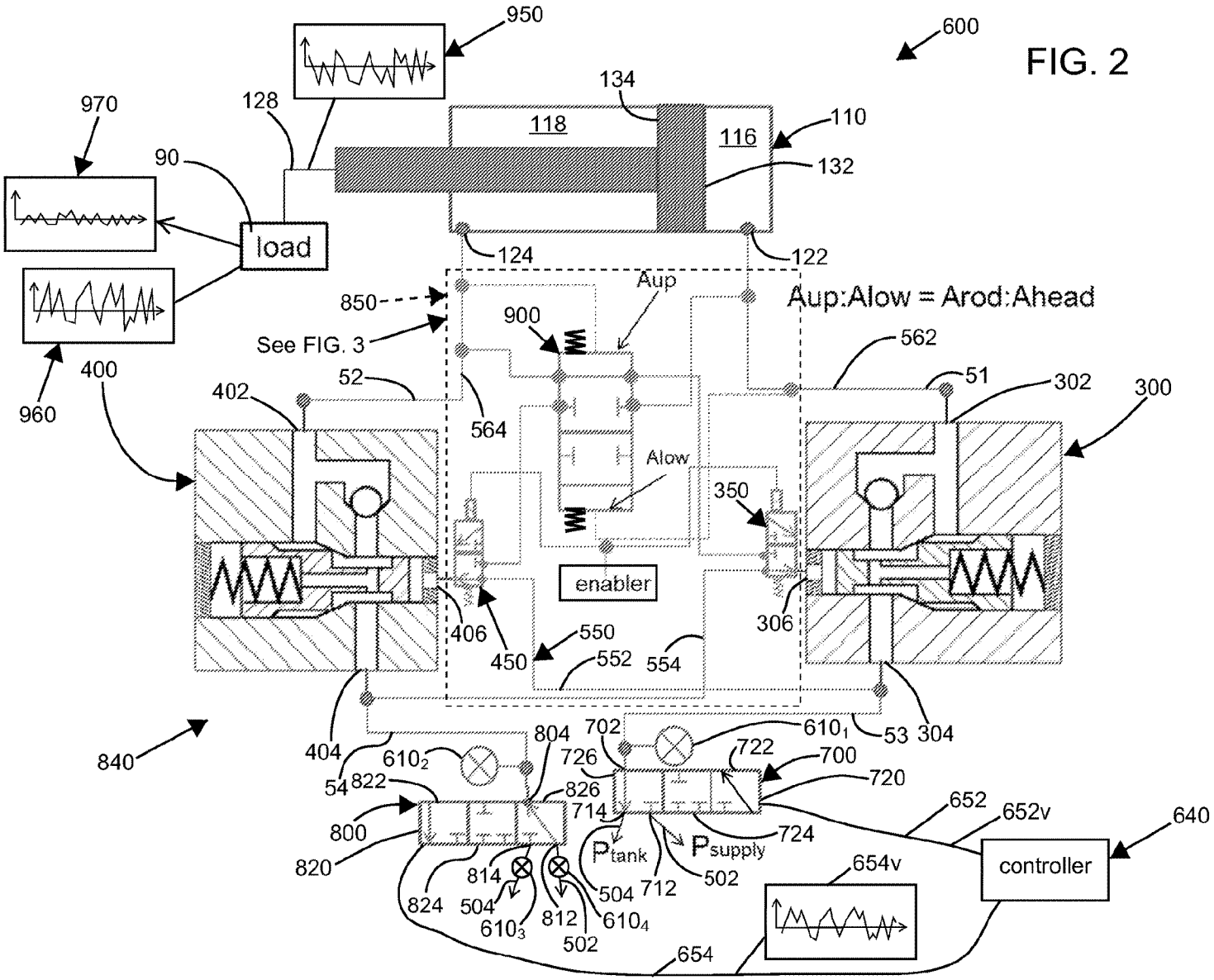
FIG. 2 is a schematic illustration of a hydraulic system including the hydraulic cylinder and the counter-balance valves of FIG. 1 configured with a hydraulic cylinder control system according to the principles of the present disclosure.

According to the principles of the present disclosure, a hydraulic system is adapted to actuate the hydraulic cylinder 110, including the counter-balance valves 300 and 400, and further provide means for counteracting vibrations to which the hydraulic cylinder 110 is exposed. As illustrated at FIG. 2, an example system 600 is illustrated with the hydraulic cylinder 110 (i.e., a hydraulic actuator), the counter-balance valve 300, and the counter-balance valve 400. The hydraulic cylinder 110 and the counter-balance valves 300, 400 of FIG. 2 may be the same as those shown in the prior art system 100 of FIG. 1. The hydraulic system 600 may therefore be retrofitted to an existing and/or a conventional hydraulic system. Certain features of the hydraulic cylinder 110 and the counter-balance valves 300, 400 will not be redundantly re-described.

According to the principles of the present disclosure, similar protection is provided by the counter-balance valves 300, 400 for the hydraulic cylinder 110 and the hydraulic system 600, as described above with respect to the hydraulic system 100. In particular, failure of a hydraulic line, a hydraulic valve, and/or a hydraulic pump will not lead to an uncommanded movement of the hydraulic cylinder 110 of the hydraulic system 600. The hydraulic architecture of the hydraulic system 600 further provides the ability to counteract vibrations using the hydraulic cylinder 110.

The hydraulic cylinder 110 may hold a net load 90 that, in general, may urge retraction or extension of a rod 126 of the cylinder 110. The rod 126 is connected to the piston 120 of the cylinder 110. If the load 90 urges extension of the hydraulic cylinder 110, the chamber 118 on a rod side 114 of the hydraulic cylinder 110 is pressurized by the load 90, and the counter-balance valve 400 acts to prevent the release of hydraulic fluid from the chamber 118 and thereby acts as a safety device to prevent uncommanded extension of the hydraulic cylinder 110. In other words, the counter-balance valve 400 locks the chamber 118. In addition to providing safety, the locking of the chamber 118 prevents drifting of the cylinder 110. Vibration control may be provided via the hydraulic cylinder 110 by dynamically pressurizing and depressurizing the chamber 116 on a head side 112 of the hydraulic cylinder 110. As the hydraulic cylinder 110, the structure to which the hydraulic cylinder 110 is attached, and the hydraulic fluid within the chamber 118 are at least slightly deformable, selective application of hydraulic pressure to the chamber 116 will cause movement (e.g., slight movement) of the hydraulic cylinder 110. Such movement, when timed in conjunction with a system model and dynamic measurements of the system, may be used to counteract vibrations of the system.

If the load 90 urges retraction of the hydraulic cylinder 110, the chamber 116 on the head side 112 of the hydraulic cylinder 110 is pressurized by the load 90, and the counter-balance valve 300 acts to prevent the release of hydraulic fluid from the chamber 116 and thereby acts as a safety device to prevent uncommanded retraction of the hydraulic cylinder 110. In other words, the counter-balance valve 300 locks the chamber 116. In addition to providing safety, the locking of the chamber 116 prevents drifting of the cylinder 110. Vibration control may be provided via the hydraulic cylinder 110 by dynamically pressurizing and depressurizing the chamber 118 on the rod side 114 of the hydraulic cylinder 110. As the hydraulic cylinder 110, the structure to which the hydraulic cylinder 110 is attached, and the hydraulic fluid within the chamber 116 are at least slightly deformable, selective application of hydraulic pressure to the chamber 118 will cause movement (e.g., slight movement) of the hydraulic cylinder 110. Such movement, when timed in conjunction with the system model and dynamic measurements of the system, may be used to counteract vibrations of the system.

The load 90 is depicted as attached via a rod connection 128 to the rod 126 of the cylinder 110. In certain embodiments, the load 90 is a tensile or a compressive load across the rod connection 128 and the head side 112 of the cylinder 110.

As is further described below, the system 600 provides a control framework and a control mechanism to achieve boom vibration reduction for both off-highway vehicles and on-highway vehicles. The vibration reduction may be adapted to reduced vibrations in booms with relatively low natural frequencies (e.g., the concrete pump truck boom). The hydraulic system 600 may also be applied to booms with relatively high natural frequencies (e.g., an excavator boom). Compared with conventional solutions, the hydraulic system 600 achieves vibration reduction of booms with fewer sensors and a simplified control structure. The vibration reduction method may be implemented while assuring protection from failures of certain hydraulic lines, hydraulic valves, and/or hydraulic pumps, as described above. The protection from failure may be automatic and/or mechanical. In certain embodiments, the protection from failure may not require any electrical signal and/or electrical power to engage. The protection from failure may be a regulatory requirement (e.g., an ISO standard). The regulatory requirement may require certain mechanical means of protection that is provided by the hydraulic system 600.

Certain booms may include stiffness and inertial properties that can transmit and/or amplify dynamic behavior of the load 90. As the dynamic load 90 may include external force/position disturbances that are applied to the boom, severe vibrations (i.e., oscillations) may result especially when these disturbances are near the natural frequency of the boom. Such excitation of the boom by the load 90 may result in safety issues and/or decrease productivity and/or reliability of the boom system. By measuring parameters of the hydraulic system 600 and responding appropriately, effects of the disturbances may be reduced and/or minimized or even eliminated. The response provided may be effective over a wide variety of operating conditions. According to the principles of the present disclosure, vibration control may be achieved using minimal numbers of sensors.

According to the principles of the present disclosure, hydraulic fluid flow to the chamber 116 of the head 112 side of the cylinder 110, and hydraulic fluid flow to the chamber 118 of the rod side 114 of the cylinder 110 are independently controlled and/or metered to realize boom vibration reduction and also to prevent the cylinder 110 from drifting. According to the principles of the present disclosure, the hydraulic system 600 may be configured similar to a conventional counter-balance system (e.g., the hydraulic system 100).

In certain embodiments, the hydraulic system 600 is configured to the conventional counter-balance configuration when a movement of the cylinder 110 is commanded. As further described below, the hydraulic system 600 enables measurement of pressures within the chambers 116 and/or 118 of the cylinder 110 at a remote location away from the hydraulic cylinder 110 (e.g., at sensors 610). This architecture thereby may reduce mass that would otherwise be positioned on the boom and/or may simplify routing of hydraulic lines (e.g., hard tubing and hoses). Performance of machines such as concrete pump booms and/or lift handlers may be improved by such simplified hydraulic line routing and/or reduced mass on the boom.

The counter-balance valves 300 and 400 may be components of a valve arrangement 840. The valve arrangement 840 may include various hydraulic components that control and/or regulate hydraulic fluid flow to and/or from the hydraulic cylinder 110. The valve arrangement 840 may further include a control valve 700 (e.g., a proportional hydraulic valve), a control valve 800 (e.g., a proportional hydraulic valve), and a selector valve arrangement 850, described in detail below. The control valves 700 and/or 800 may be high bandwidth and/or high resolution control valves.

In the depicted embodiment of FIG. 2, a node 51 is defined at the port 302 of the counter-balance valve 300 and the port 122 of the hydraulic cylinder 110; a node 52 is defined at the port 402 of the counter-balance valve 400 and the port 124 of the hydraulic cylinder 110; a node 53 is defined at the port 304 of the counter-balance valve 300 and the port 702 of the hydraulic valve 700; a node 54 is defined at the port 404 of the counter-balance valve 400 and the port 804 of the hydraulic valve 800; a node 55 is defined at the port 306 of the counter-balance valve 300 and a port 352 of a hydraulic valve 350; and a node 56 is defined at the port 406 of the counter-balance valve 400 and a port 452 of a hydraulic valve 450. The hydraulic valves 350 and 450 are described in detail below.

Figure 4:
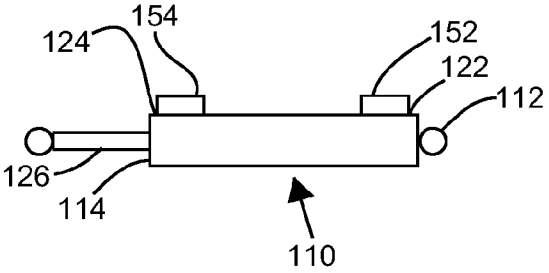
FIG. 4 is a schematic illustration of a hydraulic cylinder suitable for use with the hydraulic cylinder control system of FIG. 2 according to the principles of the present disclosure.

Turning now to FIG. 4, the hydraulic cylinder 110 is illustrated with valve blocks 152, 154. The valve blocks 152, 154 may be separate from each other, as illustrated, or may be a single combined valve block. The valve block 152 may be mounted to and/or over the port 122 of the hydraulic cylinder 110, and the valve block 154 may be mounted to and/or over the port 124 of the hydraulic cylinder 110. The valve blocks 152, 154 may be directly mounted to the hydraulic cylinder 110. The valve block 152 may include the counter-balance valve 300, and the valve block 154 may include the counter-balance valve 400. The valve blocks 152 and/or 154 may include additional components of the valve arrangement 840. The valve blocks 152, 154, and/or the single combined valve block may include the selector valve arrangement 850 and/or components thereof.

Figure 5:
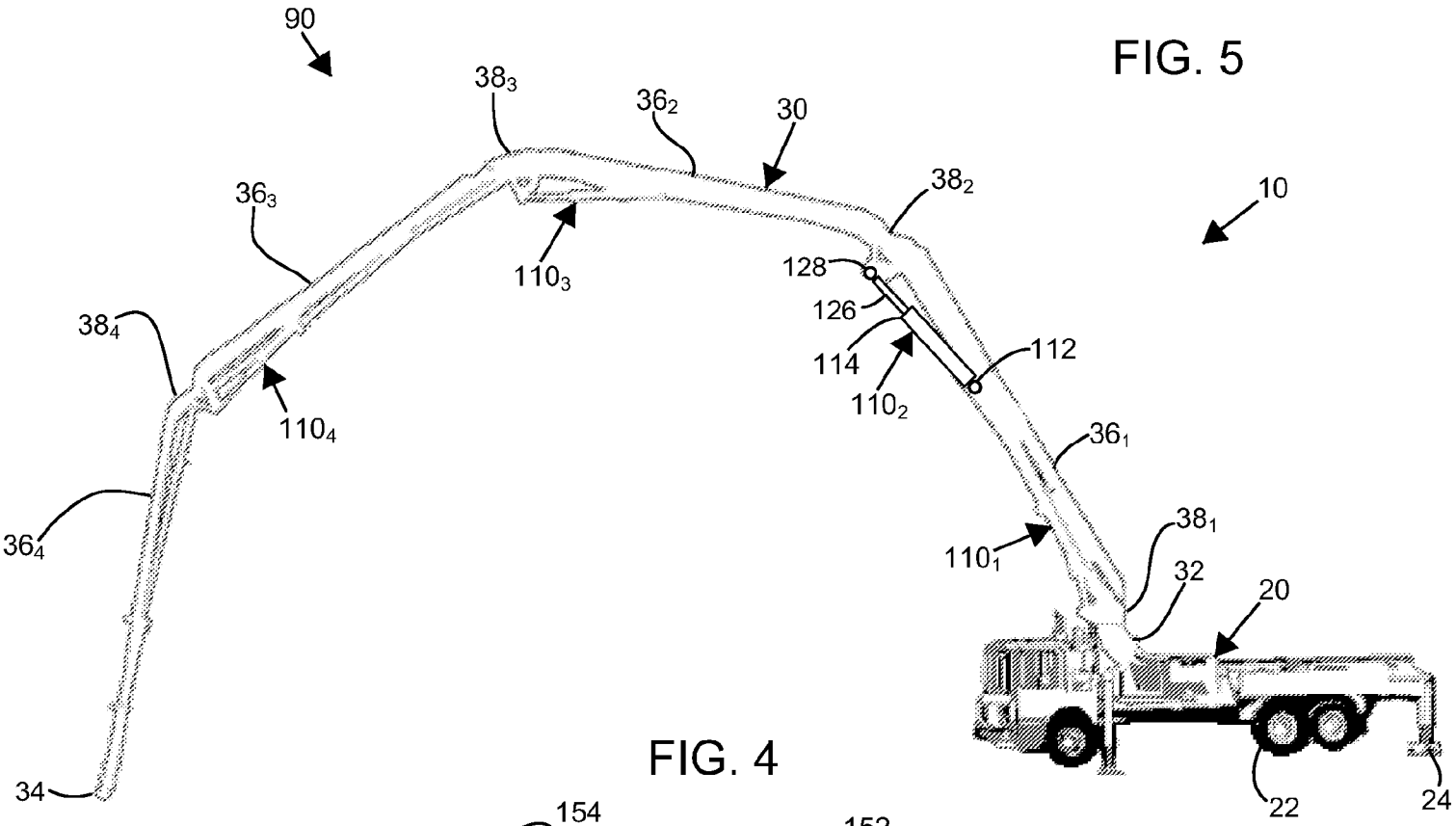
FIG. 5 is a schematic illustration of a vehicle with a boom system that is actuated by one or more cylinders and controlled with the hydraulic system of FIG. 2 according to the principles of the present disclosure.

Turning now to FIG. 5, an example boom system 10 is described and illustrated in detail. The boom system 10 may include a vehicle 20 and a boom 30. The vehicle 20 may include a drive train 22 (e.g., including wheels and/or tracks). As depicted at FIG. 5, rigid retractable supports 24 are further provided on the vehicle 20. The rigid supports 24 may include feet that are extended to contact the ground and thereby support and/or stabilize the vehicle 20 by bypassing ground support away from the drive train 22 and/or suspension of the vehicle 20. In other vehicles (e.g., vehicles with tracks, vehicles with no suspension), the drive train 22 may be sufficiently rigid and retractable rigid supports 24 may not be needed and/or provided.

As depicted at FIG. 5, the boom 30 extends from a first end 32 to a second end 34. As depicted, the first end 32 is rotatably attached (e.g., by a turntable) to the vehicle 20. The second end 34 may be positioned by actuation of the boom 30 and thereby be positioned as desired. In certain applications, it may be desired to extend the second end 34 a substantial distance away from the vehicle 20 in a primarily horizontal direction. In other embodiments, it may be desired to position the second end 34 vertically above the vehicle 20 a substantial distance. In still other applications, the second end 34 of the boom 30 may be spaced both vertically and horizontally from the vehicle 20. In certain applications, the second end 34 of the boom 30 may be lowered into a hole and thereby be positioned at an elevation below the vehicle 20.

As depicted, the boom 30 includes a plurality of boom segments 36. Adjacent pairs of the boom segments 36 may be connected to each other by a corresponding joint 38. As depicted, a first boom segment $\mathbf{36}_1$ is rotatably attached to the vehicle 20 at a first joint $\mathbf{38}_1$. The first boom segment $\mathbf{36}_1$ may be mounted by two rotatable joints. For example, the first rotatable joint may include a turntable, and the second rotatable joint may include a horizontal axis. A second boom segment $\mathbf{36}_2$ is attached to the first boom segment $\mathbf{36}_1$ at a second joint $\mathbf{38}_2$. Likewise, a third boom segment $\mathbf{36}_3$ is attached to the second boom segment $\mathbf{36}_2$ at a joint $\mathbf{38}_3$, and a fourth boom segment $\mathbf{36}_4$ is attached to the third boom segment $\mathbf{36}_3$ at a fourth joint $\mathbf{38}_4$. A relative position/orientation between the adjacent pairs of the boom segments 36 may be controlled by a corresponding hydraulic cylinder 110. For example, a relative position/orientation between the first boom segment $36_1$ and the vehicle 20 is controlled by a first hydraulic cylinder $110_1$. The relative position/orientation between the first boom segment $36_1$ and the second boom segment $36_2$ is controlled by a second hydraulic cylinder $110_2$. Likewise, the relative position/orientation between the third boom segment $36_3$ and the second boom segment $36_2$ may be controlled by a third hydraulic cylinder $110_3$, and the relative position/orientation between the fourth boom segment $36_4$ and the third boom segment $36_3$ may be controlled by a fourth hydraulic cylinder $110_4$.

According to the principles of the present disclosure, the boom 30, including the plurality of boom segments $36_{1-4}$, may be modeled and vibration of the boom 30 may be controlled by a controller 640. In particular, the controller 640 may send a signal 652 to the valve 700 and a signal 654 to the valve 800. The signal 652 may include a vibration component 652*v*, and the signal 654 may include a vibration component 654*v*. The vibration component 652*v*, 654*v* may cause the respective valve 700, 800 to produce a vibratory flow and/or a vibratory pressure at the respective port 702, 804. The vibratory flow and/or the vibratory pressure may be transferred through the respective counter-balance valve 300, 400 and to the respective chamber 116, 118 of the hydraulic cylinder 110.

Figure 3:
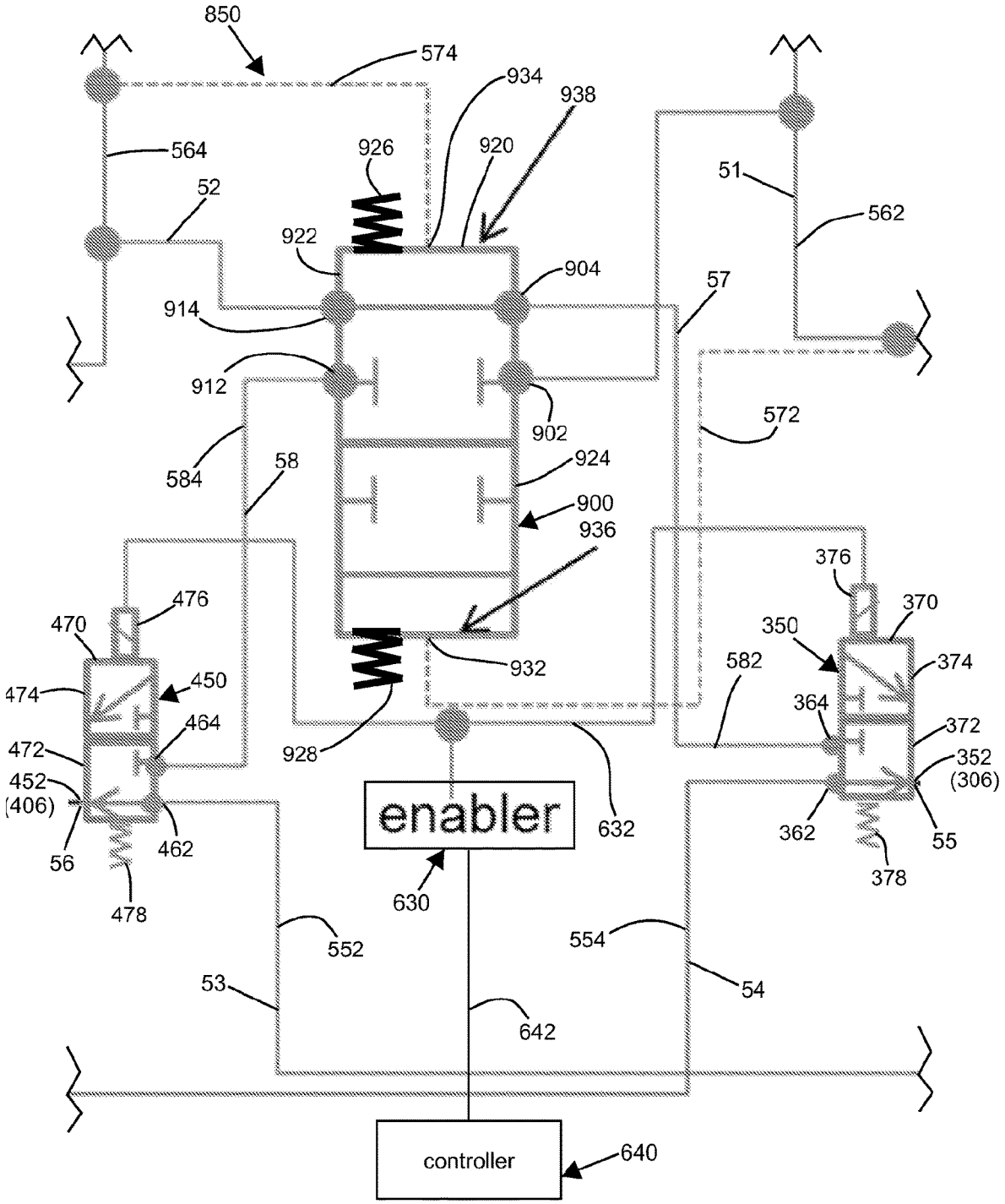
FIG. 3 is an enlarged portion of FIG. 2.

The signals 652, 654 of the controller 640 may also include move signals that cause the hydraulic cylinder 110 to extend and retract, respectively, and thereby actuate the boom 30. As depicted at FIG. 3, the controller also sends an enable signal 642 to the selector valve arrangement 850. As shown, the enable signal 642 is transmitted to an enabler 630 which, in turn, sends a valve signal 632 to each of the valves 350 and 450. Upon receiving the valve signal 632, the valves 350 and 450 enable the selector valve arrangement 850. Upon enablement, the selector valve arrangement 850 selects one of the counter-balance valves 300, 400 as a holding counter-balance valve and selects the other of the counter-balance valves 400, 300 as a vibration flow/pressure transferring counter-balance valve. In the depicted embodiment, a loaded one of the chambers 116, 118 of the hydraulic cylinder 110, that is loaded by the net load 90, corresponds to the holding counter-balance valve 300, 400, and an unloaded one of the chambers 118, 116 of the hydraulic cylinder 110, that is not loaded by the net load 90, corresponds to the vibration flow/pressure transferring counter-balance valve 400, 300. In certain embodiments, the vibration component 652*v* or 654*v* may be transmitted to the control valve 800, 700 that corresponds to the unloaded one of the chambers 118, 116 of the hydraulic cylinder 110.

The controller 640 may receive input from various sensors, including the sensors 610, position sensors, LVDTs, vision base sensors, etc. and thereby compute the signals 652, 654, including the vibration component 652*v*, 654*v*. The controller 640 may include a dynamic model of the boom 30 and use the dynamic model and the input from the various sensors to calculate the signals 652, 654, including the vibration component 652*v*, 654*v*. In certain embodiments, the enable signal 642 is transmitted directly to the valves 350 and 450 from the controller 640.

In certain embodiments, a single system such as the hydraulic system 600 may be used on one of the hydraulic cylinders 110 (e.g., the hydraulic cylinder $110_1$). In other embodiments, a plurality of the hydraulic cylinders 110 may each be actuated by a corresponding hydraulic system 600. In still other embodiments, all of the hydraulic cylinders 110 may each be actuated by a system such as the system 600.

As illustrated at FIG. 2, the example hydraulic system 600 includes the proportional hydraulic control valve 700 and the proportional hydraulic control valve 800. The example hydraulic system 600 further includes the hydraulic valve 350, the hydraulic valve 450, and a hydraulic valve 900. As depicted, the selector valve arrangement 850 includes the hydraulic valve 350, the hydraulic valve 450, and the hydraulic valve 900. In the example embodiment, the hydraulic valves 700 and 800 are three-way three position proportional valves, the valves 350 and 450 are two-way two position valves, and the valve 900 is a four-way two position valve. The valves 700 and 800 may be combined within a common valve body. In certain embodiments, some or all of the valves 300, 350, 400, 450, 700, 800, and/or 900 of the hydraulic system 600 may be combined within a common valve body and/or a common valve block. In certain embodiments, some or all of the valves 300, 350, 400, 450, 700, 800, and/or 900 of the valve arrangement 840 may be combined within a common valve body and/or a common valve block. In certain embodiments, some or all of the valves 300, 350, 400, 450, and/or 900 of the valve arrangement 840 may be combined within a common valve body and/or a common valve block. In certain embodiments, some or all of the valves 350, 450, and/or 900 of the selector valve arrangement 850 may be combined within a common valve body and/or a common valve block.

Turning now to FIG. 2, certain elements of the hydraulic system 600 will be described in detail. The hydraulic valve 700 includes a spool 720 with a first configuration 722, a second configuration 724, and a third configuration 726. As illustrated, the spool 720 is at the third configuration 726. The valve 700 includes a port 702, a port 712, and a port 714. In the first configuration 722, the port 714 is blocked off, and the port 702 is fluidly connected to the port 712. In the second configuration 724, the ports 702, 712, 714 are all blocked off. In the third configuration 726, the port 702 is fluidly connected to the port 714, and the port 712 is blocked off.

The hydraulic valve 800 includes a spool 820 with a first configuration 822, a second configuration 824, and a third configuration 826. As illustrated, the spool 820 is at the third configuration 826. The valve 800 includes a port 804, a port 812, and a port 814. In the first configuration 822, the port 812 is blocked off, and the port 804 is fluidly connected to the port 814. In the second configuration 824, the ports 804, 812, 814 are all blocked off. In the third configuration 826, the port 804 is fluidly connected to the port 812, and the port 814 is blocked off.

In the depicted embodiment, a hydraulic line 562 connects the port 302 of the counter-balance valve 300 with the port 122 of the hydraulic cylinder 110 and with a port 902 of the valve 900. The hydraulic line 562 may include a hydraulic line 572 that extends to a control port 932 of the valve 900. The hydraulic line 572 may be a capillary line and have a delayed pressure response from the hydraulic line 562. Node 51 may include the hydraulic line 562. A hydraulic line 564 may connect the port 402 of the counter-balance valve 400 with the port 124 of the hydraulic cylinder 110 and with a port 914 of the valve 900. The hydraulic line 564 may include a hydraulic line 574 that extends to a control port 934 of the valve 900. The hydraulic line 574 may be a capillary line and have a delayed pressure response from the hydraulic line 564. Node 52 may include the hydraulic line 564. In certain embodiments, the hydraulic lines 562, 564 are included in valve blocks, housings, etc. and may be short in length. A hydraulic line 552 may connect the port 304 of the counter-balance valve 300 with the port 702 of the hydraulic valve 700 and with a port 462 of the valve 450. Node 53 may include the hydraulic line 552. Likewise, a hydraulic line 554 connects the port 404 of the counterbalance valve 400 with the port 804 of the valve 800 and with a port 362 of the valve 350. Node 54 may include the hydraulic line 554.

Sensors that measure temperature and/or pressure at various ports of the valves 700, 800 may be provided. In particular, a sensor $\mathbf{610}_1$ is provided adjacent the port 702 of the valve 700. As depicted, the sensor $\mathbf{610}_1$ is a pressure sensor and may be used to provide dynamic information about the system 600 and/or the boom system 10. As depicted at FIG. 2, a second sensor $\mathbf{610}_2$ is provided adjacent the port 804 of the hydraulic valve 800. The sensor $\mathbf{610}_2$ may be a pressure sensor and may be used to provide dynamic information about the hydraulic system 600 and/or the boom system 10. As further depicted at FIG. 2, a third sensor $\mathbf{610}_3$ may be provided adjacent the port 814 of the valve 800, and a fourth sensor $\mathbf{610}_4$ may be provided adjacent the port 812 of the valve 800.

In certain embodiments, pressure within the supply line 502 and/or pressure within the tank line 504 are well known, and the pressure sensors $\mathbf{610}_1$ and $\mathbf{610}_2$ may be used to calculate flow rates through the valves 700 and 800, respectively. In other embodiments, a pressure difference across the valve 700, 800 is calculated. For example, the pressure sensor $\mathbf{610}_3$ and the pressure sensor $\mathbf{610}_2$ may be used when the spool 820 of the valve 800 is at the first position 822 and thereby calculate flow through the valve 800. Likewise, a pressure difference may be calculated between the sensor $\mathbf{610}_2$ and the sensor $\mathbf{610}_4$ when the spool 820 of the valve 800 is at the third configuration 826. The controller 640 may use these pressures and pressure differences as control inputs.

Temperature sensors may further be provided at and around the valves 700, 800 and thereby refine the flow measurements by allowing calculation of the viscosity and/or density of the hydraulic fluid flowing through the valves 700, 800. The controller 640 may use these temperatures as control inputs.

Although depicted with the first sensor $\mathbf{610}_1$, the second sensor $\mathbf{610}_2$, the third sensor $\mathbf{610}_3$, and the fourth sensor $\mathbf{610}_4$, fewer sensors or more sensors than those illustrated may be used in alternative embodiments. Further, such sensors may be positioned at various other locations in other embodiments. In certain embodiments, the sensors 610 may be positioned within a common valve body. In certain embodiments, an Ultronics® servo valve available from Eaton Corporation may be used. The Ultronics® servo valve provides a compact and high performance valve package that includes two three-way valves (i.e., the valves 700 and 800), the pressure sensors 610, and a pressure regulation controller. The Eaton Ultronics® servo valve further includes linear variable differential transformers (LVDT) that monitor positions of the spools 720, 820, respectively. By using the two three-way proportional valves 700, 800, the pressures of the chambers 116 and 118 may be independently controlled. In addition, the flow rates into and/or out of the chambers 116 and 118 may be independently controlled. In other embodiments, the pressure of one of the chambers 116, 118 may be independently controlled with respect to a flow rate into and/or out of the opposite chambers 116, 118.

In comparison with using a single four-way proportional valve 200 (see FIG. 1), the configuration of the hydraulic system 600 can achieve and accommodate more flexible control strategies with less energy consumption. For example, when the cylinder 110 is moving, the valve 700, 800 connected with the metered-out chamber 116, 118 can manipulate the chamber pressure while the valves 800, 700 connected with the metered-in chamber can regulate the flow entering the chamber 118, 116. As the metered-out chamber pressure is not coupled with the metered-in chamber flow, the metered-out chamber pressure can be regulated to be low and thereby reduce associated throttling losses.

Turning again to FIG. 3, the valves 350, 450, and 900 will be described in detail. The valve 350 is a two-way two position valve. In particular, the valve 350 includes the first port 352, the second port 362, and a third port 364. The valve 350 includes a spool 370 with a first configuration 372 and a second configuration 374. In the first configuration 372 (depicted at FIG. 3), the port 352 and the port 362 are connected, and the port 364 is blocked. In the configuration 374, the port 364 and the port 352 are connected and the port 362 is blocked. As depicted, the valve 350 includes a solenoid 376 and a spring 378. The solenoid 376 and the spring 378 can be used to move the spool 370 between the first configuration 372 and the second configuration 374.

The valve 450 is also a two-way two position valve. In particular, the valve 450 includes the first port 452, the second port 462, and a third port 464. The valve 450 includes a spool 470 with a first configuration 472 and a second configuration 474. In the first configuration 472 (also depicted at FIG. 3), the port 452 and the port 462 are connected, and the port 464 is blocked. In the configuration 474, the port 464 and the port 452 are connected and the port 462 is blocked. As depicted, the valve 470 includes a solenoid 476 and a spring 478. The solenoid 476 and the spring 478 can be used to move the spool 470 between the first configuration 472 and the second configuration 474.

The valve 900 is a four-way two position valve. In particular, the valve 900 includes the first port 902, a second port 904, a third port 912, and the fourth port 914. The valve 900 includes a spool 920 that may be configured in a first configuration 922 (depicted at FIG. 3) and a second configuration 924. In the first configuration, the ports 904 and 914 are connected, and the ports 902 and 912 are blocked. In the second configuration 924, the ports 902 and 912 are connected, and the ports 904 and 914 are blocked. The spool 920 of the valve 900 is moved by a combination of springs 926 and 928 and pressure applied at the first control port 932 and the second control port 934.

When the pressure is applied to the control port 932, the spring 926 is compressed, and the spool 920 is urged toward the configuration 924. Likewise, when the pressure is applied to the control port 934, the spring 928 is compressed, and the spool 920 is urged toward the configuration 922. Pressure applied to the port 932 acts on an area 936. Likewise, pressure applied at the port 934 acts on an area 938. As an area 132 (e.g., a head side area) acted on by pressure within the chamber 116 may be different than an area 134 (e.g., a rod side area) acted on by pressure in the chamber 118, the areas 936, 938 may also be different and thereby compensate for the area differences between the head side 112 and the rod side 114 of the cylinder 110.

To prevent excessive shuttling of the valve 900 when the net load 90 is light, a dead-band may be defined by the valve 900. In certain embodiments, a hysteresis of the springs 926 and/or 928 ranges from about 10% to about 20% of a maximum full scale load. The maximum full scale load may be defined when either the chamber 116 or the chamber 118 is at its maximum holding capacity and supplies a corresponding pressure to the valve 900.

The valve 350 is connected to the fluid line 554 at the port 362. Likewise, the valve 450 is connected to the fluid line 552 at the port 462. A fluid line 582 connects the port 364 of the valve 350 to the port 904 of the valve 900. A node 57 may include the fluid line 582. Likewise, a fluid line 584 connects the port 464 of the valve 450 to the port 912 of the valve 900. A node 58 may include the fluid line 584. The fluid line 562 further connects to the port 902 of the valve 900. Likewise, the fluid line 564 further connects to the port 914 of the valve 900. As depicted at FIG. 3, the fluid line 574 extends from the fluid line 564 and connects to the port 934. The fluid line 574 may be at substantially a same pressure as the fluid line 564. In other embodiments, the fluid line 574 may be a capillary line or have other flow restriction such as an orifice. The pressure at the port 934 may thereby be different from the pressure in the fluid line 564, at least instantaneously different. Likewise, the fluid line 572 extends from the fluid line 562 and connects to the port 932. The fluid line 572 may be at substantially a same pressure as the fluid line 562. In other embodiments, the fluid line 572 may be a capillary line or have other flow restriction such as an orifice. The pressure at the port 932 may thereby be different from the pressure in the fluid line 562, at least instantaneously different.

The supply line 502, the return line 504, the hydraulic line 552, the hydraulic line 554, the hydraulic line 562, the hydraulic line 564, the hydraulic line 572, the hydraulic line 574, the hydraulic line 582, and/or the hydraulic line 584 may belong to a line set 550.

Turning now to FIGS. 2 and 3, the operation of the selector valve arrangement 850 will be described in detail. As mentioned above, the controller 640 sends a signal to the enabler 630 which, in turn, sends a signal to the valves 350 and 450. In certain embodiments, the signal sent to the valves 350 and 450 is synchronized and sent simultaneously to both of the valves 350 and 450. Upon the signal to the valves 350, 450 being a disabled signal, the selector valve arrangement 850 configures the valve arrangement 840 in a conventional counter-balance arrangement. The conventional counter-balance arrangement may be engaged when moving the boom 30 under move commands to the control valves 700, 800. In the disabled configuration, the valve 900 of the selector valve arrangement 850 may still sense the pressures in the first chamber 116 and the second chamber 118. The valve 900 may thereby continue to shuttle between the first configuration 922 and the second configuration 924, even when the selector valve arrangement 850 is disabled.

When the controller 640 sends an enable signal to the enabler 630, and the enabler 630 sends an enable signal to the valves 350, 450, the valve 350 moves to the second configuration 374, and the valve 450 moves to the second configuration 474. In certain embodiments, in the enabled configuration, the valve arrangement 840 effectively locks the hydraulic cylinder 110 from moving. In particular, regardless of the position of the valve 900, one of the valves 350 or 450 will not receive high pressure and therefore will not transmit the high pressure to the corresponding counter-balance valve 300, 400. As mentioned above, the enabled configuration of the selector valve arrangement 850 may be used to lock one of the chambers 116, 118 of the hydraulic cylinder 110 while sending vibratory pressure to an opposite one of the chambers 118, 116. The vibratory pressure may be used to counteract external vibrations encountered by the boom 30.

When the net load 90 is carried by the chamber 118, pressure from the chamber 118 is applied at the port 934 of the valve 900 and urges the valve 900 toward the first configuration 922. In the first configuration 922, the port 904 and the port 914 of the valve 900 are connected and thereby connect the node 52 with the node 57. As the valve 350 is enabled, and in the second configuration 374, the nodes 52 and 57 are further connected to the node 55. A passage for the high pressure fluid from the chamber 118 is thereby opened to the port 306 of the counter-balance valve 300. The counter-balance valve 300 is thereby opened for bi-directional flow between the ports 302 and 304. Opening up the counter-balance valve 300 to bi-directional flow allows the control valve 700 to apply and release hydraulic fluid pressure from the chamber 116 under the control of the controller 640.

When the net load 90 is carried by the chamber 116, pressure from the chamber 116 is applied at the port 932 of the valve 900 and urges the valve 900 toward the second configuration 924. In the second configuration 924, the port 902 and the port 912 of the valve 900 are connected and thereby connect the node 51 with the node 58. As the valve 450 is enabled, and in the second configuration 474, the nodes 51 and 58 are further connected to the node 56. A passage for the high pressure fluid from the chamber 116 is thereby opened to the port 406 of the counter-balance valve 400. The counter-balance valve 400 is thereby opened for bi-directional flow between the ports 402 and 404. Opening up the counter-balance valve 400 to bi-directional flow allows the control valve 800 to apply and release hydraulic fluid pressure from the chamber 118 under the control of the controller 640.

As schematically illustrated at FIG. 2, an environmental vibration load 960 is imposed as a component of the net load 90 on the hydraulic cylinder 110. As depicted at FIG. 2, the vibration load component 960 does not include a steady state load component. In certain applications, the vibration load 960 includes dynamic loads such as wind loads, momentum loads of material that may be moved along the boom 30, inertial loads from moving the vehicle 20, and/or other dynamic loads. The steady state load may include gravity loads that may vary depending on the configuration of the boom 30. The vibration load 960 may be sensed and estimated/measured by the various sensors 610 and/or other sensors. The controller 640 may process these inputs and use a model of the dynamic behavior of the boom system 10 and thereby calculate and transmit an appropriate vibration signal 652*v*, 654*v*. The signal 652*v*, 654*v* is transformed into hydraulic pressure and/or hydraulic flow at the corresponding valve 700, 800. The vibratory pressure/flow is transferred through the corresponding counter-balance valve 300, 400 and to the corresponding chamber 116, 118 of the hydraulic cylinder 110. The hydraulic cylinder 110 transforms the vibratory pressure and/or the vibratory flow into a vibratory response force/displacement 950. When the vibratory response 950 and the vibration load 960 are superimposed on the boom 30, a resultant vibration 970 is produced. The resultant vibration 970 may be substantially less than a vibration of the boom 30 generated without the vibratory response 950. Vibration of the boom 30 may thereby be controlled and/or reduced enhancing the performance, durability, safety, usability, etc. of the boom system 10. The vibratory response 950 of the hydraulic cylinder 110 is depicted at FIG. 2 as a dynamic component of the output of the hydraulic cylinder 110. The hydraulic cylinder 110 may also include a steady state component (i.e., a static component) that may reflect static loads such as gravity.

Figure 6:
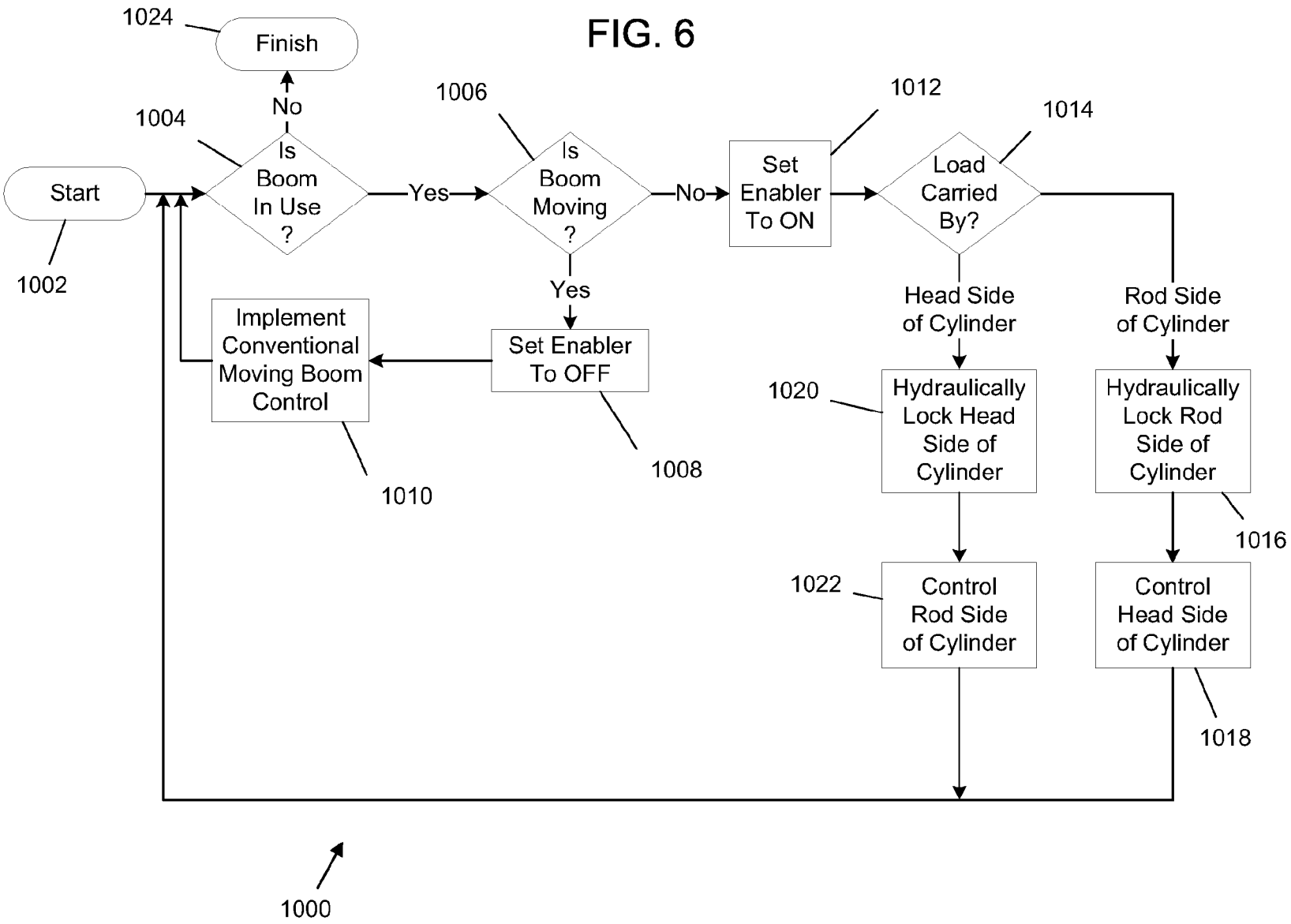
FIG. 6 is a flow chart illustrating an example method for controlling a cylinder used to position a boom, such as the hydraulic cylinder of FIG. 4, according to the principles of the present disclosure.

Turning now to FIG. 6, an example method 1000 of controlling vibration in a boom system 10 is given. In particular, the method 1000 may begin at a start point 1002.

Upon starting at the start point 1002, a decision point 1004 is reached. If the boom 30 is in use, control is advanced to a decision point 1006. If the boom 30 is not in use, a finish point 1024 is reached. If the boom 30 is moving at the decision point 1006, control is advanced to step 1008 where the enabler 630 is set to off. Control is then advanced to step 1010 where conventional boom moving control may be implemented. Control then advances to the decision point 1004. At the decision point 1006, if the boom 30 is not moving, control advances to step 1012 where the enabler 630 is set to on. Control then advances to decision point 1014. At the decision point 1014, if the net load 90 is carried by the chamber 118, then control is advanced to step 1016 where the chamber 118 of the hydraulic cylinder 110 is locked. Control then advances to step 1018 where vibration control is executed on the chamber 116 and control is then advanced to the decision point 1004. At the decision point 1014, if the net load 90 is carried by the chamber 116, control is advanced to step 1020. At the step 1020, the chamber 116 is locked and control then advances to step 1022. At the step 1022, vibration control is executed on the chamber 118. Control is then advanced to the decision point 1004.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A hydraulic system for actuating a boom, the hydraulic system comprising:

a hydraulic actuator including a first chamber and a second chamber;

a first control valve fluidly connected to the first chamber;

a second control valve fluidly connected to the second chamber, the first and second control valves being independently operable with respect to each other; and a plurality of input sensors associated with the hydraulic system;

a controller that interfaces with the plurality of input sensors and the first and second control valves, wherein the controller is configured to generate a vibration control signal as a function of signals received form the plurality of input sensors, wherein the vibration control signal is transmitted to at least one of the first and second control valves to produce a vibratory control response applied to at least one of the first and second chambers.

2. The hydraulic system of claim 1, wherein the plurality of input signals includes first and second pressure sensors that interface with the controller for respectively sensing pressures corresponding to the first and second chambers of the hydraulic actuator.

3. The hydraulic system of claim 1, wherein the controller interfaces with the first and second control valves to control extension and retraction of the hydraulic actuator.

4. The hydraulic system of claim 3, wherein the controller can apply the vibratory control signal while the hydraulic actuator is extending or retracting.

5. The hydraulic system of claim 3, wherein the controller can apply the vibratory control signal while the hydraulic actuator is static.

6. The hydraulic system of claim 1, wherein the controller includes a dynamic model to compute the vibration control signal from the signals received from the plurality of input signals.

7. The hydraulic system of claim 1, wherein the plurality of input sensors includes one or more of pressure sensors, position sensors, optical sensors, and temperature sensors.

8. The hydraulic system of claim 1, wherein the controller calculates a flow rate or a pressure difference through the first and second valves based on input signals received from the plurality of input sensors.

* * * * *